US008425146B2

(12) United States Patent
Merriam

(10) Patent No.: US 8,425,146 B2
(45) **Date of Patent: *Apr. 23, 2013**

(54) PERMEABLE PAVING SYSTEM

(75) Inventor: Howard Merriam, Minneapolis, MN (US)

(73) Assignee: Studio5051, LLC, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/397,242

(22) Filed: Feb. 15, 2012

(65) Prior Publication Data

US 2012/0213583 A1 Aug. 23, 2012

Related U.S. Application Data

(63) Continuation-in-part of application No. 13/226,866, filed on Sep. 7, 2011.

(60) Provisional application No. 61/444,619, filed on Feb. 18, 2011.

(51) Int. Cl.
*E01C 5/00* (2006.01)

(52) U.S. Cl.
USPC ..... 404/39; 52/605

(58) Field of Classification Search ..... 404/34, 404/37, 38, 39, 41; 52/603, 605; D25/113
See application file for complete search history.

(56) References Cited

U.S. PATENT DOCUMENTS

| | | | | | |
|---|---|---|---|---|---|
| 1,673,630 | A * | 6/1928 | Madge | 404/32 |
| 2,957,278 | A * | 10/1960 | Woodworth | 52/316 |
| 3,464,176 | A * | 9/1969 | Clements | 52/251 |
| 3,873,225 | A * | 3/1975 | Jakobsen et al. | 404/41 |
| 4,532,748 | A * | 8/1985 | Rotherham | 52/605 |
| D284,514 | S * | 7/1986 | McPoyle | D25/118 |
| 5,281,048 | A * | 1/1994 | Hagenah | 404/44 |
| 5,820,304 | A * | 10/1998 | Sorheim et al. | 405/286 |
| 6,863,469 | B2 * | 3/2005 | Bolduc et al. | 404/41 |
| 6,988,847 | B2 * | 1/2006 | Lazar | 404/39 |

* cited by examiner

*Primary Examiner* — Gary S Hartmann
(74) *Attorney, Agent, or Firm* — Fredrikson & Byron, P.A.

(57) ABSTRACT

A paving block is provided that includes a top surface, a bottom surface and a side surface extending between the top surface and the bottom surface. The side surface includes a recess extending from the top surface to the bottom surface, wherein the recess has a top opening in the top surface and a bottom opening in the bottom surface, wherein the bottom opening is larger in area than the top opening. The side surface also has at least a portion that extends inwardly into the paving block. In some cases, the side surface comprises an upper side surface section and a lower side surface section, wherein the lower side surface section extends inwardly into the paving block.

18 Claims, 17 Drawing Sheets

600
608
610
604
606
602
612
614
616
618
620
622
624
626
628
630
632
634
636
638

12x
8x
2x
x
602

1300
52
Section Line A 1300
52
54
50
Section Through Paver Per Reference Line Above 1300
54

50
50
50
50
1400
1500
1600
1700

2400
2408
2444
2420
2418
2422
2402
2424
2446
2426
2410
2442
2406
2416
2414
2440
2412
2404

2402
x
x
x
3x

PERMEABLE PAVING SYSTEM

CROSS REFERENCE TO RELATED APPLICATIONS

This application claims priority to U.S. Utility patent application Ser. No. 13/226,866, filed Sep. 7, 2011, which in turns claims priority to U.S. Provisional Application No. 61/444,619 filed Feb. 18, 2011, the teachings of both which are incorporated herein by reference.

TECHNICAL FIELD

The present invention relates to a permeable paving system for capturing and disposing storm-water runoff. More specifically, the invention relates to paving blocks for a permeable paving system for capturing and disposing storm-water runoff.

BACKGROUND

Paving blocks are frequently used as ground covering elements in landscaping and outdoor construction. They are widely used today in residential, commercial, and municipal applications that include walkways, patios, plazas, sidewalks, decks, parking lots, streets and the like. Paving blocks are generally stone or brick or are extruded or molded into various shapes using concrete or clay. As such, the paving blocks themselves are impervious to liquid such as rain water.

In a typical application, the paving blocks are arranged with their side surfaces in contact with each other, resulting in a substantially closed surface. More often, adjacent paving blocks are held together in place with a bonding material placed in the interface between adjacent side surfaces. The bonding material is also often impervious to liquids. As such, liquids falling on the blocks are not able to penetrate through the interfaces between the blocks. This results in either puddles forming over the blocks or a runoff of the liquid towards the edges of the paved area. This can be problematic in times where the amount of rain water runoff increases during a storm or heavy rainfall.

Accordingly, it would be desirable to have paving blocks that help reduce the amount of liquid runoff and minimize the amount of puddling. It is also desirable to provide paving blocks that can be installed to provide an aesthetically pleasant pattern or design.

SUMMARY

Some embodiments provide for a paving block. The paving block includes a top surface, a bottom surface and a side surface extending between the top surface and the bottom surface. The side surface includes a recess extending from the top surface to the bottom surface, wherein the recess has a top opening and a bottom opening, wherein the bottom opening is larger in area than the top opening. The side surface also has at least a portion that extends inwardly into the paving block. In some cases, the side surface comprises a top side surface section and a bottom side surface section, wherein the bottom side surface section extends inwardly into the paving block.

In some embodiments, the recess comprises a top recess section and a bottom recess section, wherein the bottom recess section extends inwardly into the paving block. In some cases, each the top side surface section and the top recess section are substantially vertical. Also, in some cases, the top side surface section has a height and the top recess section has a height, wherein the top side surface section height is substantially the same as the top recess section height. The bottom recess section can also extend inwardly at substantially the same angle as or at a greater angle than the bottom side surface section.

DETAILED DESCRIPTION

While multiple embodiments of the instant invention are disclosed, still other embodiments may become apparent to those skilled in the art. The following detailed description includes only illustrative embodiments of the invention wherein like elements are referenced by like numeral. It should be clearly understood that there is no intent, implied or otherwise, to limit the invention in any form or manner to that described herein. As such, all alternative embodiments of the invention are considered as falling within the spirit, scope and intent of the disclosure.

Figure 1B:
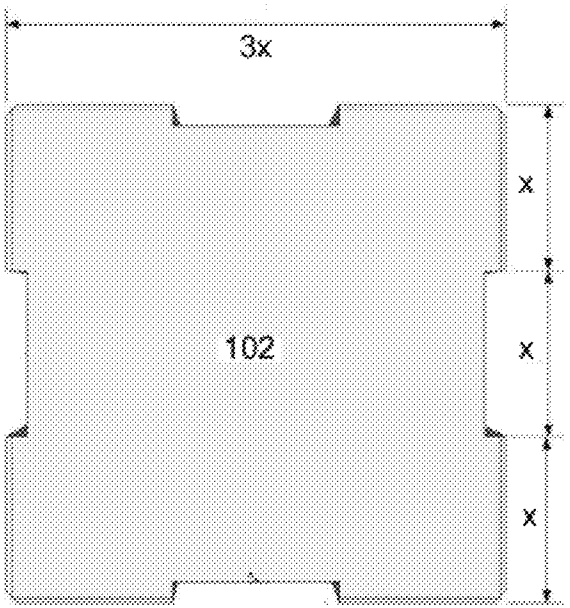
FIG. 1B is a plan view of the paving block of FIG. 1A.
Figure 1A:
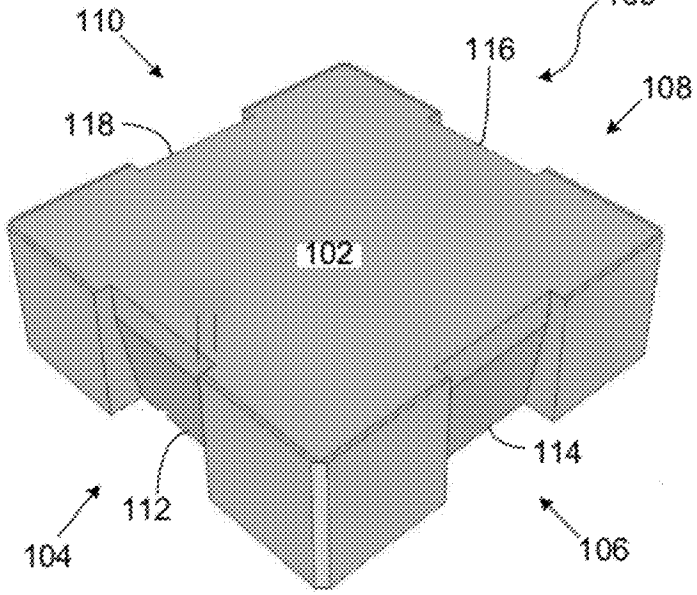
FIG. 1A is an isometric view of a paving block in accordance with one embodiment.

FIGS. 1A and 1B, respectively, are an isometric view and a plan view of a paving block 100 in accordance with an embodiment of the invention. As illustrated, the paving block 100 is a parallelepiped comprising a substantially horizontal top surface 102 and a substantially horizontal bottom surface (not shown). The paving block 100 further comprises substantially vertical side surfaces 104, 106, 108, 110 extending between the top surface 102 and the bottom surface of paving block 100. Each side surface 104, 106, 108, 110 includes recesses 112, 114, 116, 118, respectively, extending between the top surface 102 and the bottom surface of paving block 100. The recesses 112, 114, 116, 118 in the illustrated embodiment are all identical, although this is not required. Also, the paving block 100 only needs to have one recess and any number of recesses, not just four, can be provided.

Figure 2B:
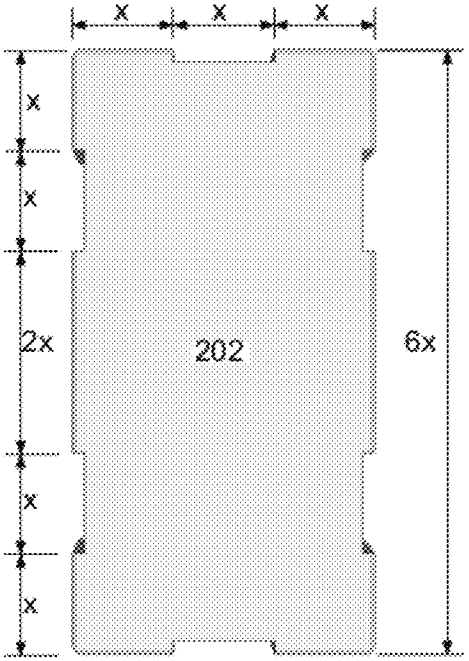
FIG. 2B is a plan view of the paving block of FIG. 2A.
Figure 2A:
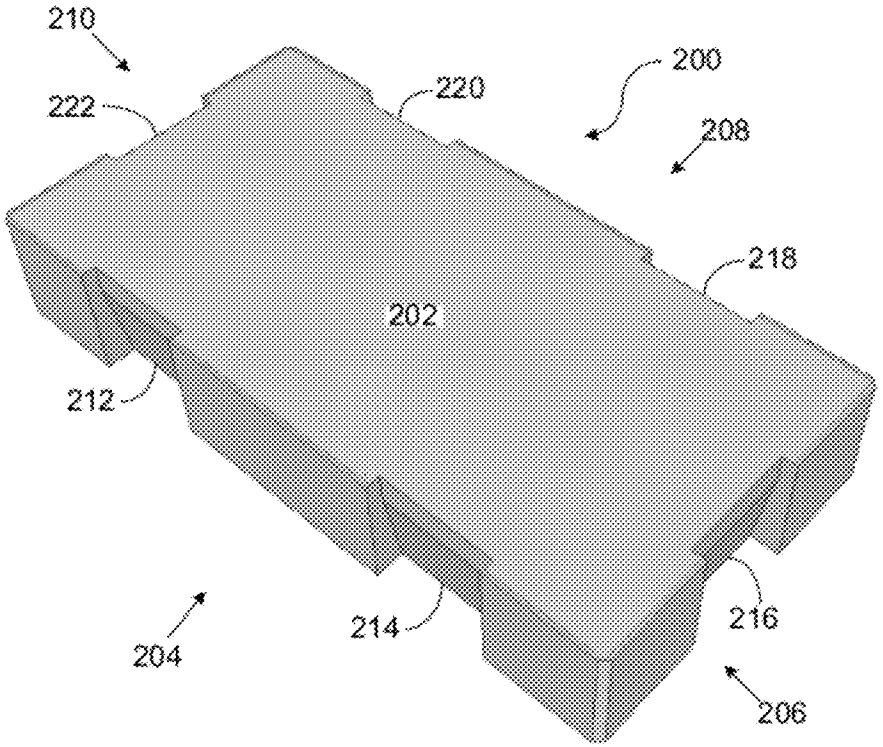
FIG. 2A is an isometric view of a paving block in accordance with another embodiment.

FIGS. 2A and 2B, respectively, are an isometric view and a plan view of a paving block 200 in accordance with another embodiment of the invention. The paving block 200 is a parallelepiped comprising a substantially horizontal top surface 202 and a substantially horizontal bottom surface (not shown). The paving block 200 further comprises side surfaces 204, 206, 208, 210 extending between the top surface 202 and the bottom surface. The side surfaces 206, 210 have a width and side surfaces 204, 208 have a different width that is essentially twice the width of the side surfaces 206, 210. Each side surface 204, 208 includes two recesses: 212, 214 and 218, 220, respectively; and each side surface 206, 210 includes one recess 216 and 222, respectively.

In general, the paving block 200 is similar to paving block 100 with the primary difference being in the area and shape of the top (and bottom) surfaces and in the total number of recesses. In other words, the paving block 100 is a square shape whereas the paving block 200 is a rectangular shape. Also, the paving block 100 has a single recess on each side surface 104, 106, 108, 110 whereas the paving block 200 has a single recess on each side surface 206, 210 and two recesses on each side surface 204, 208. The height (or thickness) of paving blocks 100 and 200 are essentially equal, although this is not required. However, it is advantageous to have paving blocks of equal heights, so that they can be used together to create a flat surface or mosaic. The recesses 212, 214, 216, 218, 220, 222 are also substantially identical to one another. Additionally, the recesses 212, 214, 216, 218, 220, 222 are substantially identical to the recesses 112, 114, 116, 118 in paving block 100, although this is not required. It is advantageous to have paving blocks with substantially identical recesses, so that they can be abutted together to form symmetric drainage holes, as will be later described.

Figure 3A:
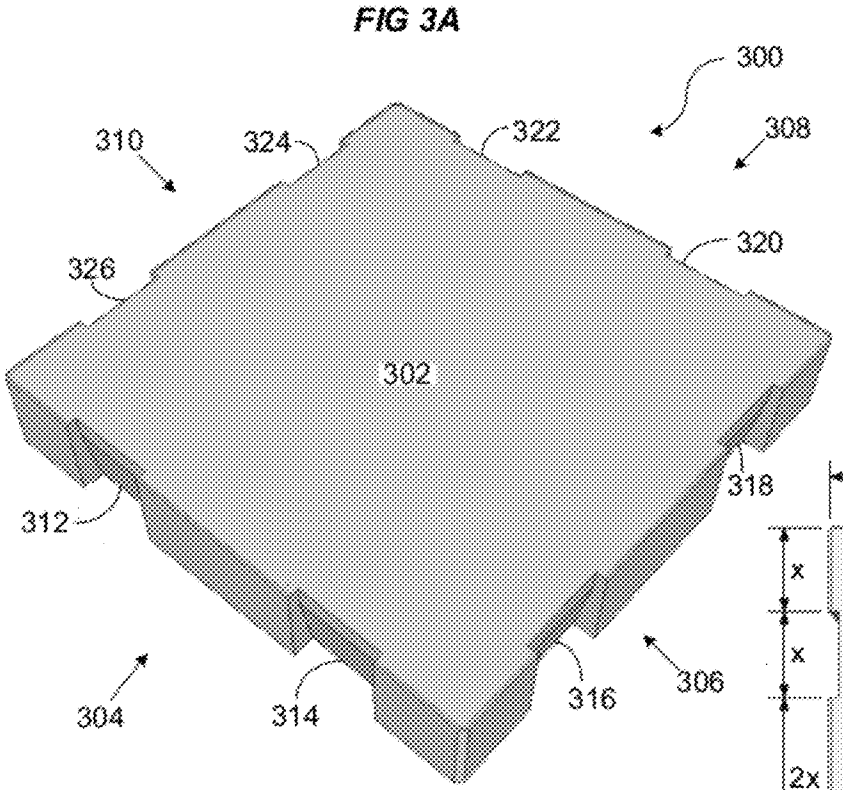
FIG. 3A is an isometric view of a paving block in accordance with another embodiment.
Figure 3B:
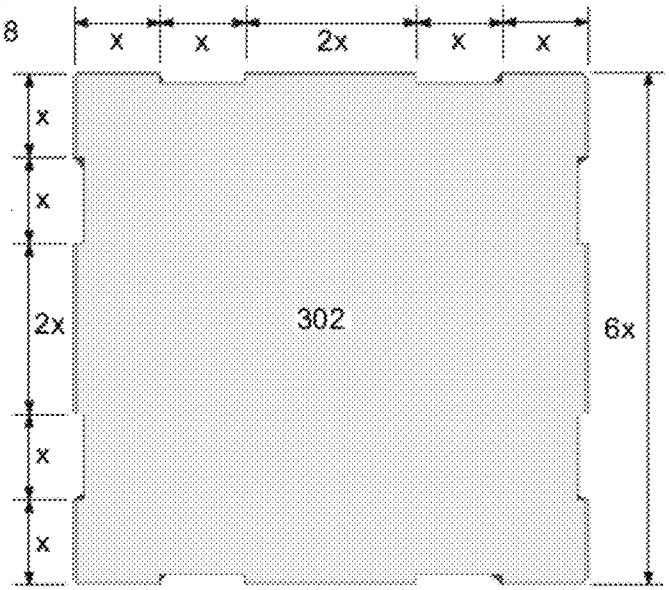
FIG. 3B is a plan view of the paving block of FIG. 3A.

FIGS. 3A and 3B, respectively, are an isometric view and a plan view of paving block 300 in accordance with another embodiment of the invention. The paving block 300 is a parallelepiped comprising a substantially horizontal top surface 302 and a substantially horizontal bottom surface (not shown). The paving block 300 further comprises side surfaces 304, 306, 308, 310 extending between the top surface 302 and the bottom surface. The side surfaces 304, 306, 308, 310 all have the same width so that the paving block 300 has a square shape. Each side surface of block 300 includes two recesses: side surface 304 includes recesses 312, 314, side surface 306 includes recesses 316, 318, side surface 308 includes recesses 320, 322 and side surface 310 includes recesses 324, 326. Each side surface 304, 306, 308, 310 and each one of their respective two recesses are substantially identical to one another. Additionally, recesses 312, 314, 316, 318, 320, 322, 324, 326 are substantially identical to recesses 212, 214, 216, 218, 220, 222 in paving block 100 and to recesses 112, 114, 116, 118 in paving block 100, although this is not required. The height (or thickness) of paving blocks 100, 200, 300 are also substantially equal, although this is not required.

Figures 4A, 4B:
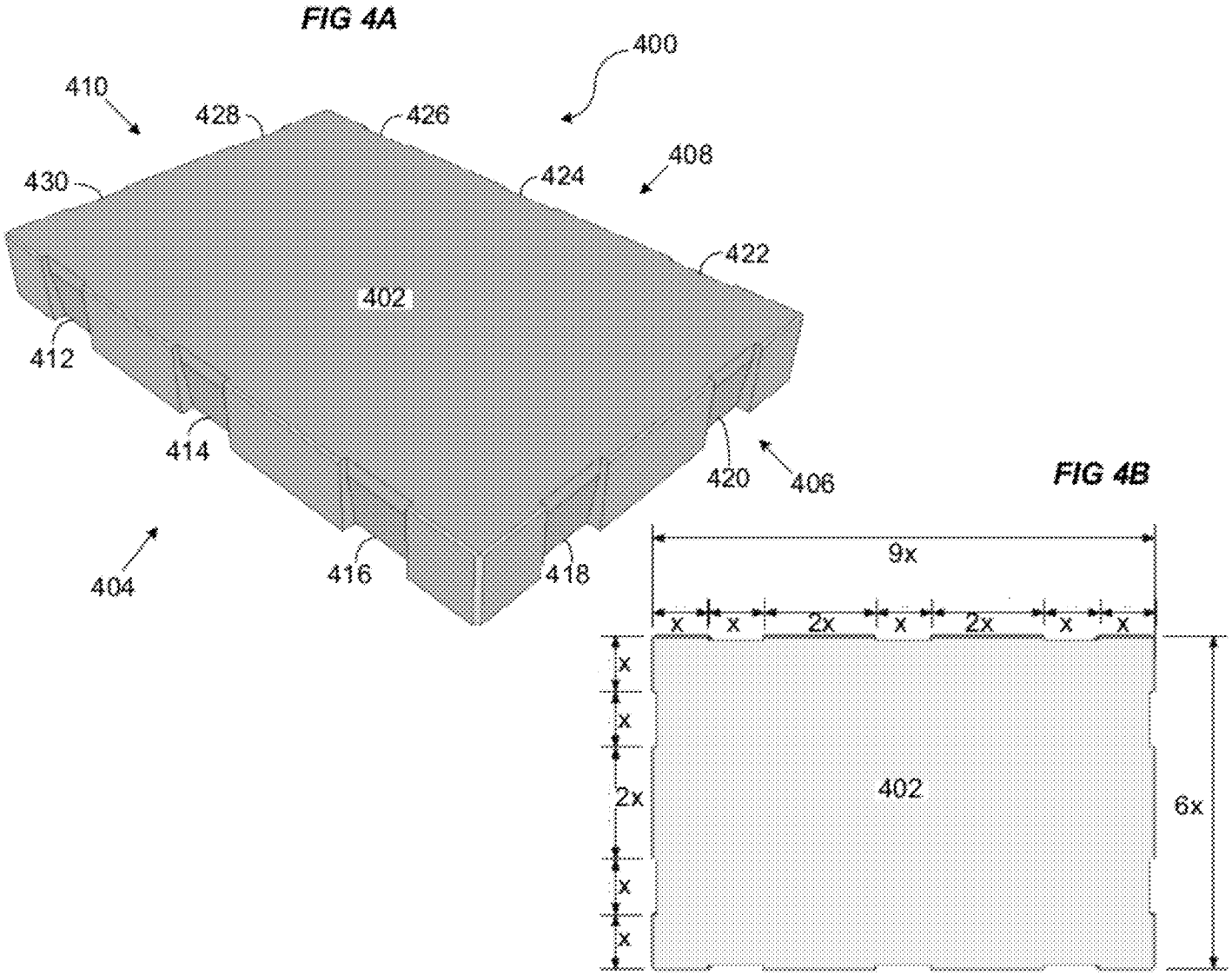
FIG. 4A is an isometric view of a paving block in accordance with another embodiment.
FIG. 4B is a plan view of the paving block of FIG. 4A.

FIGS. 4A and 4B, respectively, are an isometric view and a plan view of paving block 400 in accordance with an embodiment of the invention. The paving block 400 is a parallelepiped comprising a substantially horizontal top surface 402 and a substantially horizontal bottom surface (not shown). The paving block 400 further comprises side surfaces 404, 406, 408, 410 extending between the top surface 402 and the bottom surface. The side surfaces 406, 410 have a width and side surfaces 404, 408 have a different width that is 1½ times the width of the side surfaces 406, 410. Each side surface 404, 408 includes three recesses 412, 414, 416 and 422, 424, 426, respectively; and each side surface 406, 410 includes two recesses 418, 420 and 428, 430, respectively. Each of the recesses are substantially identical to one another, although this is not required. Additionally, the recesses 412, 414, 416, 418, 420, 422, 424, 426, 428, 430 are substantially identical to recesses 312, 314, 316, 318, 320, 322, 324, 326 in paving block 300, to recesses 212, 214, 216, 218, 220, 222 in paving block 200 and to recesses 112, 114, 116, 118 in paving block 100, although this is not required. Finally, the height (or thickness) of paving blocks 100, 200, 300, 400 are also substantially equal, although this is not required.

Figure 5A:
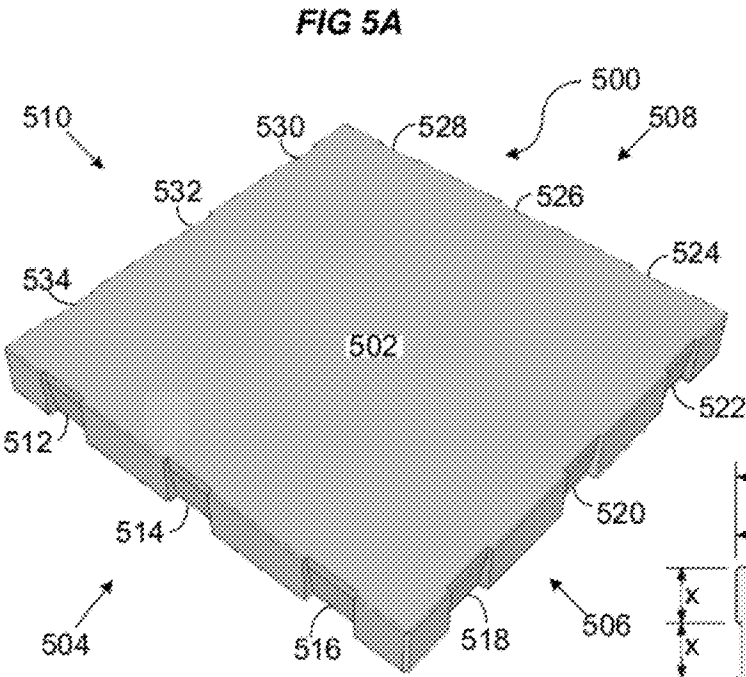
FIG. 5A is an isometric view of a paving block in accordance with another embodiment.
Figure 5B:
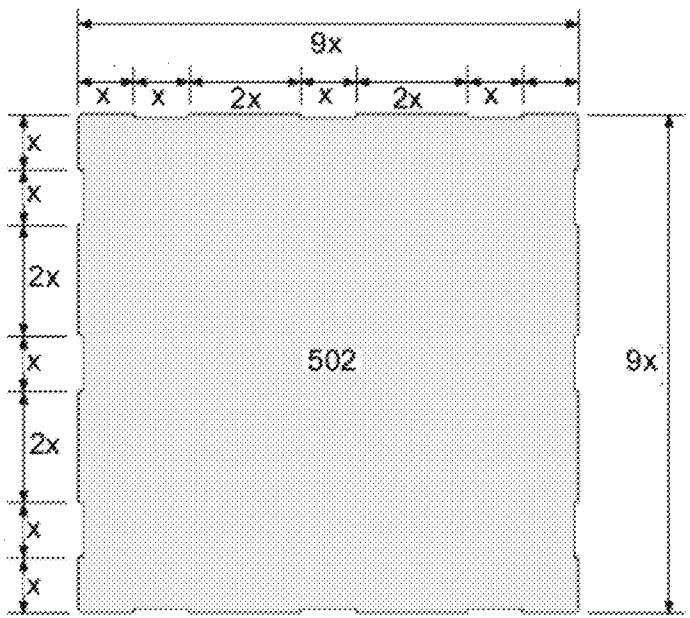
FIG. 5B is a plan view of the paving block of FIG. 5A.

FIGS. 5A and 5B, respectively, are an isometric view and a plan view of paving block 500 in accordance with another embodiment of the invention. The paving block 500 is a parallelepiped comprising a substantially horizontal top surface 502 and a substantially horizontal bottom surface (not shown). The paving block 500 further comprises side surfaces 504, 506, 508, 510 extending between the top surface 502 and the bottom surface. The side surfaces 504, 506, 508, 510 all have the same width so that the paving block 500 has a square shape. Each side surface of block 500 includes three recesses: side surface 504 includes recesses 512, 514, 516, side surface 506 includes recesses 518, 520, 522, side surface 508 includes recesses 524, 526, 528 and side surface 510 includes recesses 530, 532, 534. Each side surface 504, 506, 508, 510 and each one of their respective two recesses are substantially identical to one another, although this is not required. Additionally, recesses 512, 514, 516, 518, 520, 522, 524, 526, 528, 530, 532, 534 are substantially identical to recesses 412, 414, 416, 418, 420, 422, 424, 426, 428, 430 in paving block 400, to recesses 312, 314, 316, 318, 320, 322, 324, 326 in paving block 300, to recesses 212, 214, 216, 218, 220, 222 in paving block 200 and to recesses 112, 114, 116, 118 in paving block 100, although this is not required. The height (or thickness) of paving blocks 100, 200, 300, 400, 500 are also substantially equal, although this is not required.

Figures 6A, 6B:
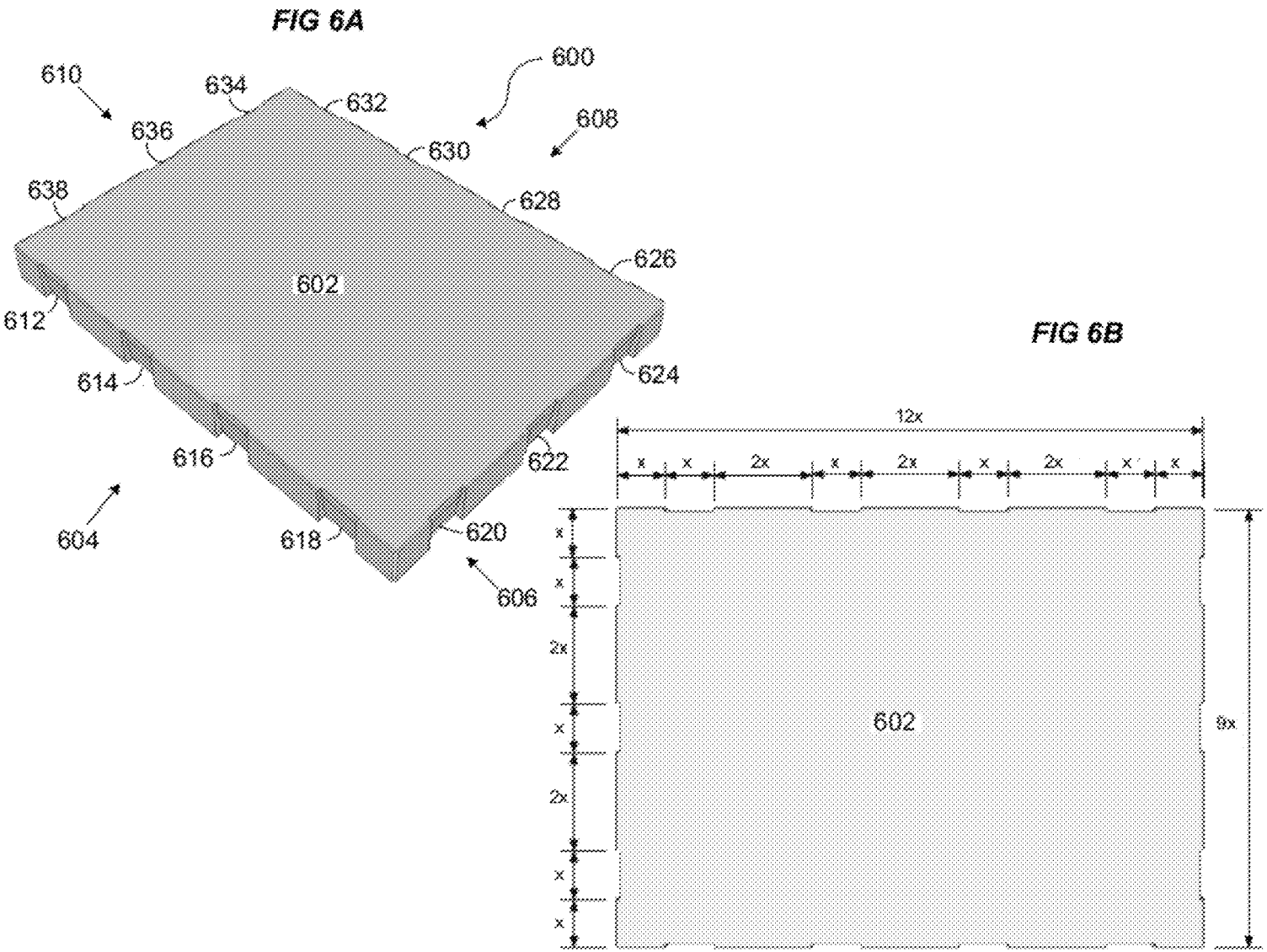
FIG. 6A is an isometric view of a paving block in accordance with another embodiment.
FIG. 6B is a plan view of the paving block FIG. 6A.

FIGS. 6A and 6B, respectively, are an isometric view and a plan view of a paving block 600 in accordance with another embodiment of the invention. The paving block 600 is a parallelepiped block comprising a substantially horizontal top surface 602 and a substantially horizontal bottom surface (not shown). The paving block 600 further comprises side surfaces 604, 606, 608, 610 extending between top surface 602 and the bottom surface. The side surfaces 606, 610 have a width and side surfaces 604, 608 have a different width that is 1½ times the width of the side surfaces 606, 610. Each side surface 604, 608, includes four recesses 612, 614, 616, 618 and 626, 628, 630, 632, respectively; and each side surface 606, 610 includes three recesses 620, 622, 624 and 634, 636, 638, respectively. Each of the recesses are substantially identical to one another, although this is not required. Additionally, recesses 612, 614, 616, 618, 620, 622, 624, 626, 628, 630, 632, 634, 636, 638 are substantially identical to recesses 512, 514, 516, 518, 520, 522, 524, 526, 528, 530, 532, 534 in paving block 500, to recesses 412, 414, 416, 418, 420, 422, 424, 426, 428, 430 in paving block 400, to recesses 312, 314, 316, 318, 320, 322, 324, 326 in paving block 300, to recesses 212, 214, 216, 218, 220, 222 in paving block 200 and to recesses 112, 114, 116, 118 in paving block 100, although this is not required. Finally, the height (or thickness) of paving blocks 100, 200, 300, 400, 500, 600 are also substantially equal, although this is not required.

Figure 7:
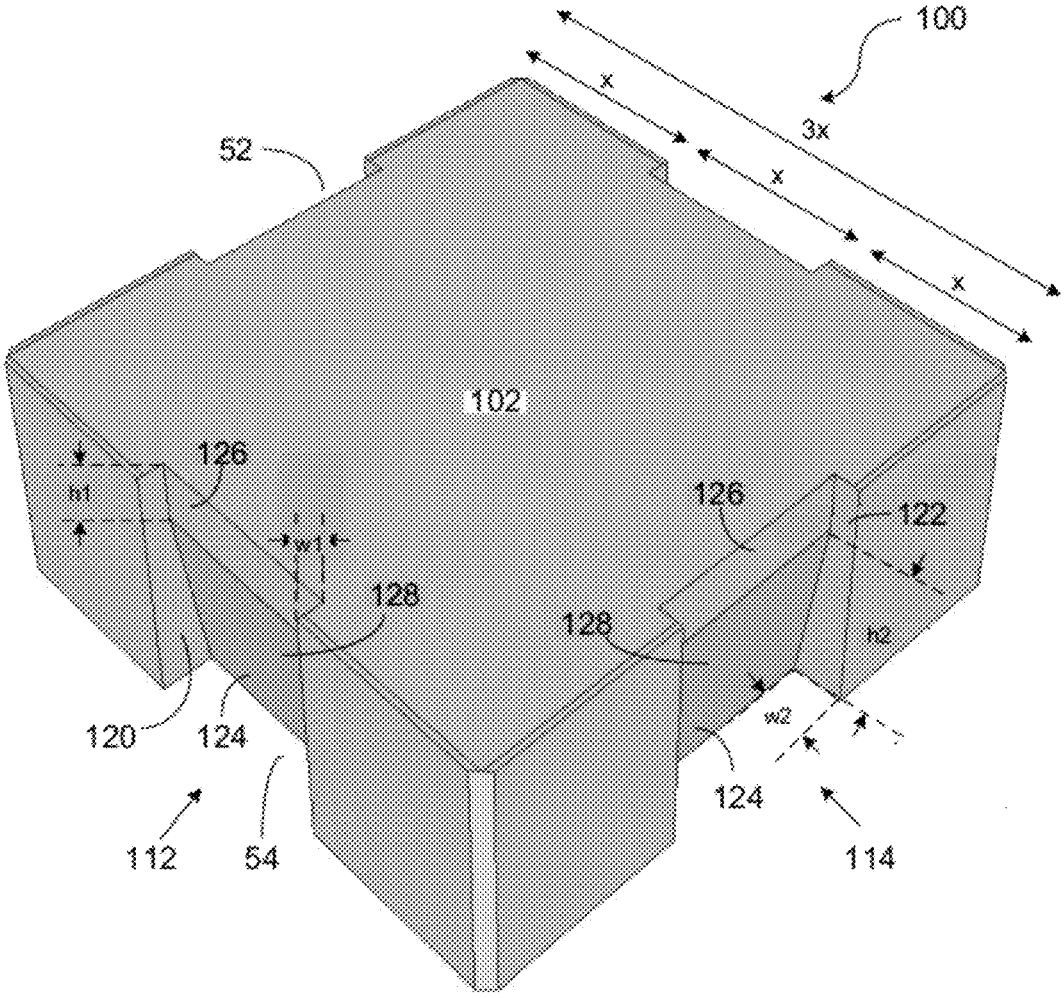
FIG. 7 is an isometric view of the paving block of FIG. 1A showing exemplary dimensions of a recess.

FIG. 7 illustrates a structure of the recesses 112, 114 of FIGS. 1A and 1B according to one embodiment. Recesses 112, 114 are exemplary recesses that can be provided in any of the blocks 100, 200, 300, 400, 500, 600 described above. In certain preferred embodiments, all of the recesses in blocks 100, 200, 300, 400, 500, 600 are substantially identical and have the structural features of recesses 112, 114 as now described. With reference to FIG. 7, the recess 112 and 114 each have opposing side surfaces 120, 122 and a back surface 124. At least one of the surfaces 120, 122, 124 has a section that extends inwardly towards or into the paving block. For example, side surface 120 can have a surface that extends inwardly towards surface 106, side surface 122 can have a surface that extends inwardly towards surface 110 and the back surface 124 can have a surface that extends inwardly towards surface 108. In some cases, substantially the entire side surface 120, side surface 122 or back surface 124 extends inwardly as it extends from the top surface 102 to the bottom surface. As used herein, the term "extends inwardly" means inclining inwardly, stairstepping inwardly, concaving inwardly or any other mechanism that causes the surface to extend inwardly. In the most cases, at least one of the surfaces 120, 122, 124 has a section that inclines inwardly towards or into the paving block.

In the illustrated embodiment, opposing side surfaces 120, 122 do not have any section that extends inwardly. Rather, the side surfaces 120, 122 are substantially vertical and parallel to each other. However, the back surface 124 has a surface that inclines inwardly towards the paving block. Specifically, the back surface 124 includes a substantially vertical surface 126 extending a height "h1" below top surface 102 and an inclining surface 128 extending a height "h2" below the substantially vertical surface 126. Also, the height "h2" of the inclining surface 128 is larger than the height "h1" of the substantially vertical surface 126, although this is not required. In alternate embodiments, substantially the entire back surface 124 extends inwardly as it extends from the top surface 102 to the bottom surface. However, the substantially vertical surface 126 is advantageous because it provides more structural integrity to the intersection of the top surface 102 and the back surface 124 of the recess. In other words, the surface 126 makes it more difficult for the intersection to chip or otherwise break as the paving block is subjected to wear and tear.

The recess 112 has a top opening 52 and a bottom opening 54, wherein the bottom opening 54 has a larger area than the top opening 52. In the illustrated embodiment, the recess 112 has a rectangular shape with rectangular dimensions. The recess has a length "x," the top opening 52 has a width "w1" and the bottom opening 54 has a width "w2." In other words, the top opening 52 and bottom opening 54 have the same length "x" but have different widths "w1," "w2," wherein the width "w2" is greater than the width "w1." In certain cases, the width "w2" is two times or more the width "w1." Of course, the top opening 52 and bottom opening 54 can have different lengths in other embodiments. Likewise, the recess 112 can have shapes other than a rectangular shape, such as semi-circular shape. A variety of designs are within the scope of the invention so long as the bottom opening 54 has a larger area than the top opening 52. Surfaces that incline, stairstep or otherwise extend inward are provided to cause the bottom opening 54 to have a larger area than the top opening 52.

Referring back to FIGS. 1B through 6B, each recess in the paving blocks 100, 200, 300, 400, 500, 600 is substantially identical and has a length "x". Also, each side surface of the paving blocks also has a length that is an integer multiple of the recess length "x." The integer multiple can include "3x," "6x," "9x," and "12x" in some embodiments. Further, the side surfaces of each paving block have a non-recessed section with a length of at least a distance "x" on each side of each recess. Specifically, in the illustrated blocks 100, 200, 300, 400, 500, 600, the spacing in between each recess is a distance "2x." Also, the spacing in between each recess and the closest adjacent corner of the paving block is "x." These specific formulas are advantageous in creating a paving block system wherein all the paving blocks are configured to match together so that their recesses abut one another.

The specific formulas of paving blocks 100, 200, 300, 400, 500, 600 will now be described. As shown in FIG. 1B, the paving block 100 has a square shape wherein each recess 112, 114, 116, 118 has a length "x" and each side surface 104, 106, 108, 110 has a length "3x." There is no spacing in between recesses since only one recess is provided per side surface. However, the spacing in between each recess 112, 114, 116, 118 and its closest adjacent corner is "x."

As shown in FIG. 2B, the paving block 200 has a rectangular shape wherein each recess 212, 214, 216, 218, 220, 222 has a length "x," each side surface 204, 208 has a length "6x" and each side surface 206, 210 has a length "3x." There is no spacing in between recesses 216, 210 since only one recess is provided per side surface 206, 210. On the other hand, there is a spacing of "2x" in between recess 212 and 214 and in between recess 218 and 220. Further, the spacing in between each recess 212, 214, 216, 218, 220, 222 and its closest adjacent corner is "x."

As shown in FIG. 3B, the paving block 300 has a square shape wherein each recess 312, 314, 316, 318, 320, 322, 324, 326 has a length "x" and each side surface 304, 306, 308, 310 has a length "6x." There is a spacing of "2x" in between recess 312 and 314, in between recess 316 and 318, in between recess 320 and 322 and in between recess 324 and 326. Further, the spacing in between each recess 312, 314, 316, 318, 320, 322, 324, 326 and its closest adjacent corner is "x."

As shown in FIG. 4B, the paving block 400 has a rectangular shape wherein each recess 412, 414, 416, 418, 420, 422, 424, 426, 428, 430 has a length "x," each side surface 404, 408 has a length "9x" and each side surface 406, 410 has a length "6x." There is a spacing of "2x" in between recess 412 and 414, in between recess 414 and 416, in between recess 418 and 420, in between recess 422 and 424, in between recess 424 and 426 and in between recess 428 and 430. Further, the spacing in between each recess 412, 416, 418, 420, 422, 426, 428, 430 and its closest adjacent corner is "x."

As shown in FIG. 5B, the paving block 500 has a square shape wherein each recess 512, 514, 516, 518, 520, 522, 524, 526, 528, 530, 532, 534 has a length "x" and each side surface 504, 506, 508, 510 has a length "9x." There is a spacing of "2x" in between recess 512 and 514, in between recess 514 and 516, in between recess 518 and 520, in between recess 520 and 522, in between recess 524 and 526, in between recess 526 and 528, in between recess 530 and 532 and in between recess 532 and 534. Further, the spacing in between each recess 512, 516, 518, 522, 524, 528, 530, 534 and its closest adjacent corner is "x."

Finally, as shown in FIG. 6B, the paving block 600 has a rectangular shape wherein each recess 612, 614, 616, 618, 620, 622, 624, 626, 628, 630, 632, 634, 636, 638 has a length "x," each side surface 604, 608 has a length "12x" and each side surface 606, 610 has a length "9x." There is a spacing of "2x" in between recess 612 and 614, in between recess 614 and 616, in between recess 616 and 618, in between recess 620 and 622, in between recess 622 and 624, in between recess 626 and 628, in between recess 628 and 630, in between recess 630 and 632, in between recess 634 and 636 and in between recess 636 and 638. Further, the spacing in between each recess 612, 618, 620, 624, 626, 632, 634, 638 and its closest adjacent corner is "x."

In an exemplarily dimensioned embodiment, such as that illustrated in FIGS. 1A and 1B, paving block 100 is 2 inches thick comprising a 6-inch square top surface 102 and bottom surface (not shown). Each one of the 2 inch high vertical side surfaces 104, 106, 108 and 110, respectively, include 2 inch wide ("x"=2 inches) recesses 112, 114, 116 and 118. The substantially vertical surface 126 has a height "h1" of ½ inches and the inclining surface 128 has a height "h2" of 1½ inches. Further, the recess has a top opening 52 with a width "w1" of 3/16 inches and a bottom opening 54 with a width "w2" of ⅜ inches. Note that the width "w2" of ⅜ inches is two times the width "w1" of 3/16 inches.

Figure 10:
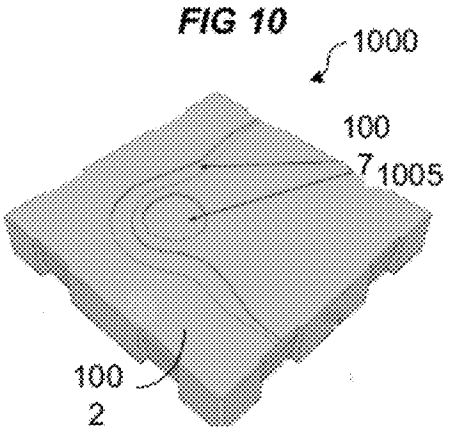
FIG. 10 is an isometric view of a paving block having a top surface design and channel in accordance with another embodiment.
Figure 9:
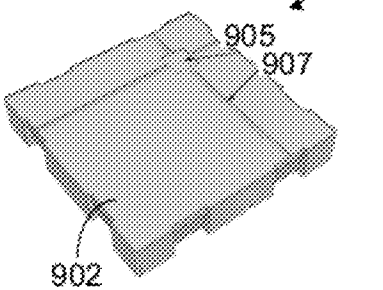
FIG. 9 is an isometric view of a paving block having a top surface design and channel in accordance with another embodiment.
Figure 8:
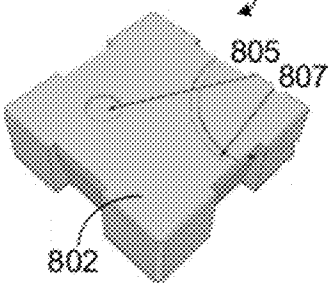
FIG. 8 is an isometric view of a paving block having a top surface design and channel in accordance with one embodiment.
Figure 12:
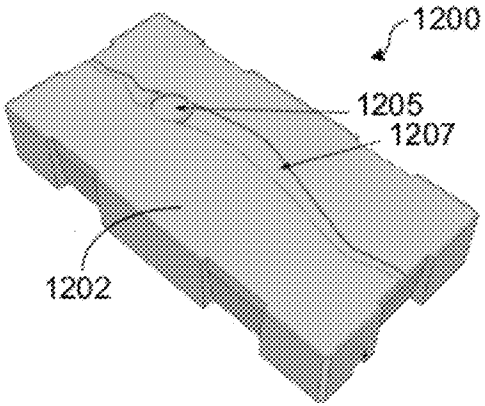
FIG. 12 is an isometric view of a paving block having a top surface design and channel in accordance with another embodiment.
Figure 11:
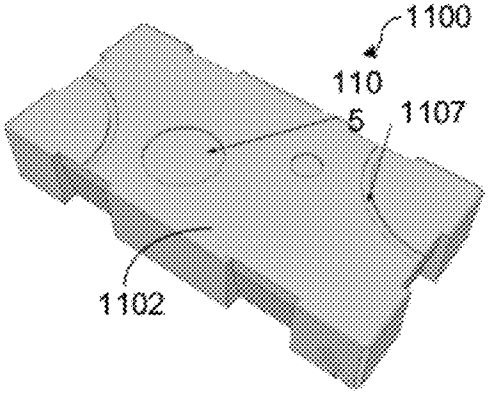
FIG. 11 is an isometric view of a paving block having a top surface design and channel in accordance with another embodiment.

In FIGS. 1A through 6B, top surfaces 102, 202, 302, 402, 502, 602 of paving blocks 100, 200, 300, 400, 500, 600 are shown as "plain" and do not include any aesthetic design. However, these blocks can indeed have one or more aesthetically pleasing designs on their top surfaces. FIGS. 8-12 show isometric views of paving blocks having different designs on the top surface. For instance, FIG. 8 shows a paving block 800 having a top surface 802 with a circular design 805 and an arced channel 807. FIG. 9 shows a paving block 900 having top surface 902 with a square design 905 and a two linear channels 907. FIG. 10 shows a paving block 1000 having a top surface 1002 with an organic design 1005 and a meandering channel 1007. FIG. 11 shows a paving block 1100 having a top surface 1102 with a circular design 1105 and an arced channel 1107. Finally, FIG. 12. shows a paving block 1200 having a top surface 1202 with an organic design 1205 and a meandering channel 1207.

In cases where a channel is included, the channel preferably runs into one or more recesses on the paving block. This way, water can be collected by the channel and directed towards one or more recesses, thereby helping to direct water off of the paving block. Different embodiments and additional single or multiple shapes and/or designs and/or channels are considered as within the scope and spirit of the instant invention. Furthermore, while the designs and channels are illustrated as having a uniform depth below the top surface of the paving blocks, they can instead have non-uniform depths. For instance, the paving blocks can include channels of non-uniform depths that gradually slopes in depth towards their respective recesses so as to guide the flow of liquids into the drainage holes. The channels improve the drainage and permeability of the paving system by directing and enhancing the flow of liquid towards the drainage holes. Further, while the top surfaces of the paving blocks are generally envisioned as being "flat", i.e., with no curvature, the paving blocks can instead have convex shaped top surfaces that generally and gradually slope towards their respective side surfaces and/or towards their recesses.

Figures 13A, 13B, 13C:
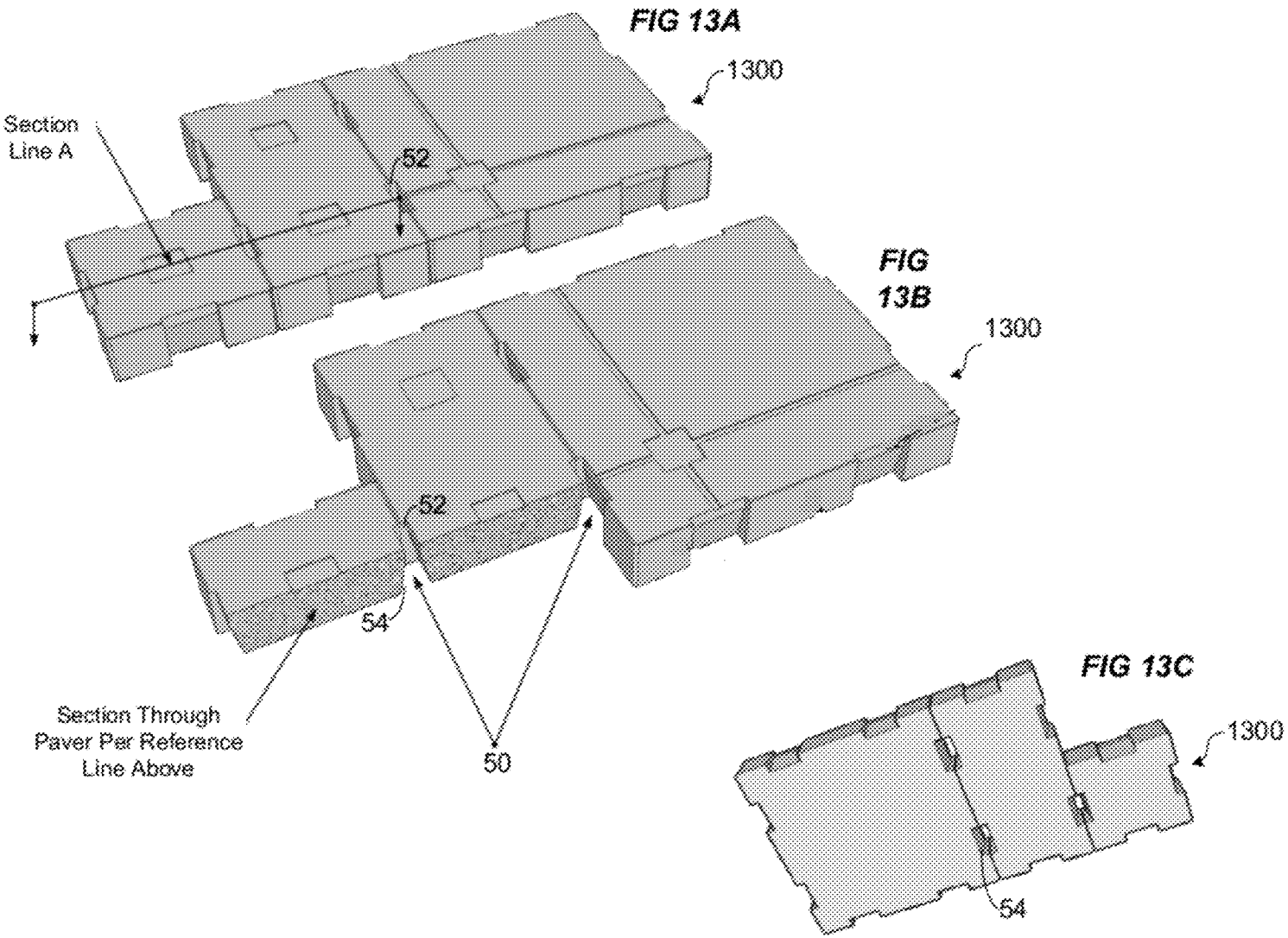
FIG. 13A is an isometric view of a paving block arrangement in accordance with one embodiment.
FIG. 13B is a sectional isometric view of FIG. 13A along line Section Line A.
FIG. 13C is an isometric bottom view of the paving block arrangement of FIG. 13A.
Figures 14, 15, 16, 17:
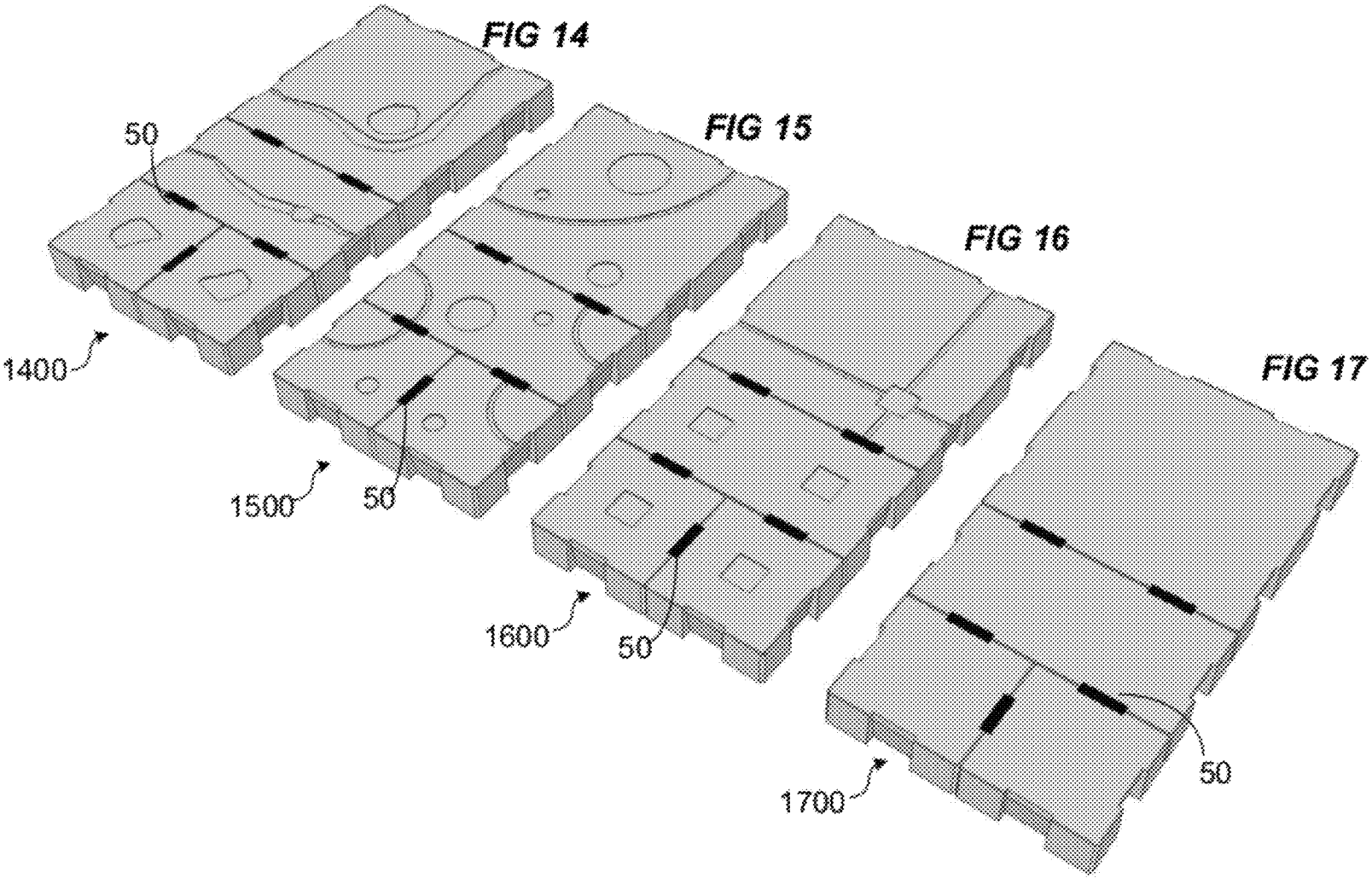
FIG. 14 is an isometric view of a paving block arrangement in accordance with one embodiment.
FIG. 15 is an isometric view of a paving block arrangement in accordance with another embodiment.
FIG. 16 is an isometric view of a paving block arrangement in accordance with another embodiment.
FIG. 17 is an isometric view of a paving block arrangement in accordance with another embodiment.
Figure 21:
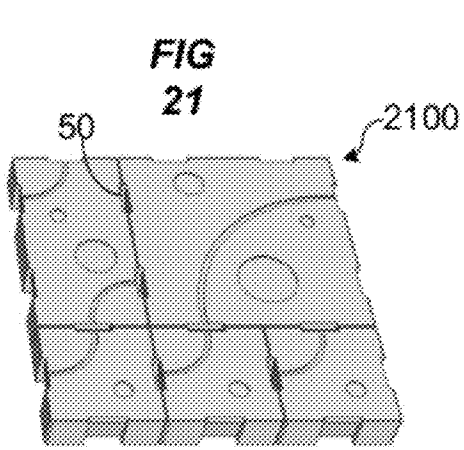
FIG. 21 is an isometric view of a paving block arrangement in accordance with another embodiment.
Figure 20:
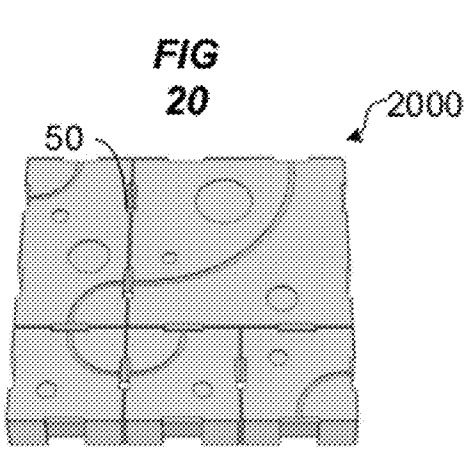
FIG. 20 is an isometric view of a paving block arrangement in accordance with another embodiment.

In use, any combination of a plurality of paving blocks 100, 200, 300, 400, 500, 600 can be positioned adjacent to one another with abutting recesses. FIGS. 13A through 13C show a paving block arrangement 1300 wherein abutting recesses create drainage holes 50 that allows liquid, such as rain water, to flow through and dissipate into the ground. The drainage holes 50 have a top opening 52 and a bottom opening 54 created by the recesses, wherein the bottom opening 54 has a larger area than the top opening 52. Accordingly, each drainage hole 50 generally "flares out" as it extends from the top surface to the bottom surface of the paving block.

In the illustrated embodiment, the drainage holes 50 have a rectangular shape and the top opening 52 has the dimensions "x" by two-"w1" and the bottom opening 54 has the dimensions "x" by two-"w2." In certain cases, w2 is at least two times w1. As such, the paving blocks provide a relatively smaller top opening to permit the entry of water into the drainage hole (without overly impacting the integrity of the surface formed by the multiple pavers) and then provide a relatively larger bottom opening to increase the surface area of the exposed ground through which liquid flowing into the chambers can be absorbed or dissipated.

Additionally, while the recesses and the drainage holes formed thereby are substantially rectangular in shape, several alternate geometric shapes and sizes are considered as within the scope and spirit of the instant invention. For instance, the recesses can be semi-circular so as to form circular drainage holes. Also, the shapes of the top and the corresponding bottom openings need not match. For instance, while the illustrated embodiments show both openings 52, 54 having a rectangular shape, the top opening 52 could be rectangular and the corresponding bottom opening could be oval 54. In such a case, if the area of the oval opening (bottom) is larger than the area of the rectangular opening (top), the pavers provide a relatively larger surface of the exposed ground to facilitate absorption or even pooling of the liquid flowing through the corresponding top opening. A variety of different designs are contemplated so long as the bottom opening 54 has a larger area than the top opening 52.

Figure 18:
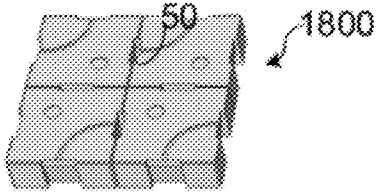
FIG. 18 is an isometric view of a paving block arrangement in accordance with another embodiment.
Figure 19:
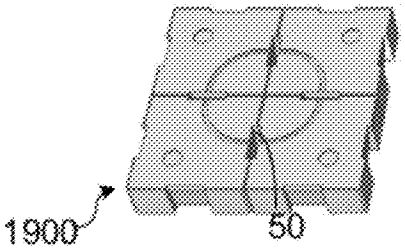
FIG. 19 is an isometric view of a paving block arrangement in accordance with another embodiment.
Figure 22:
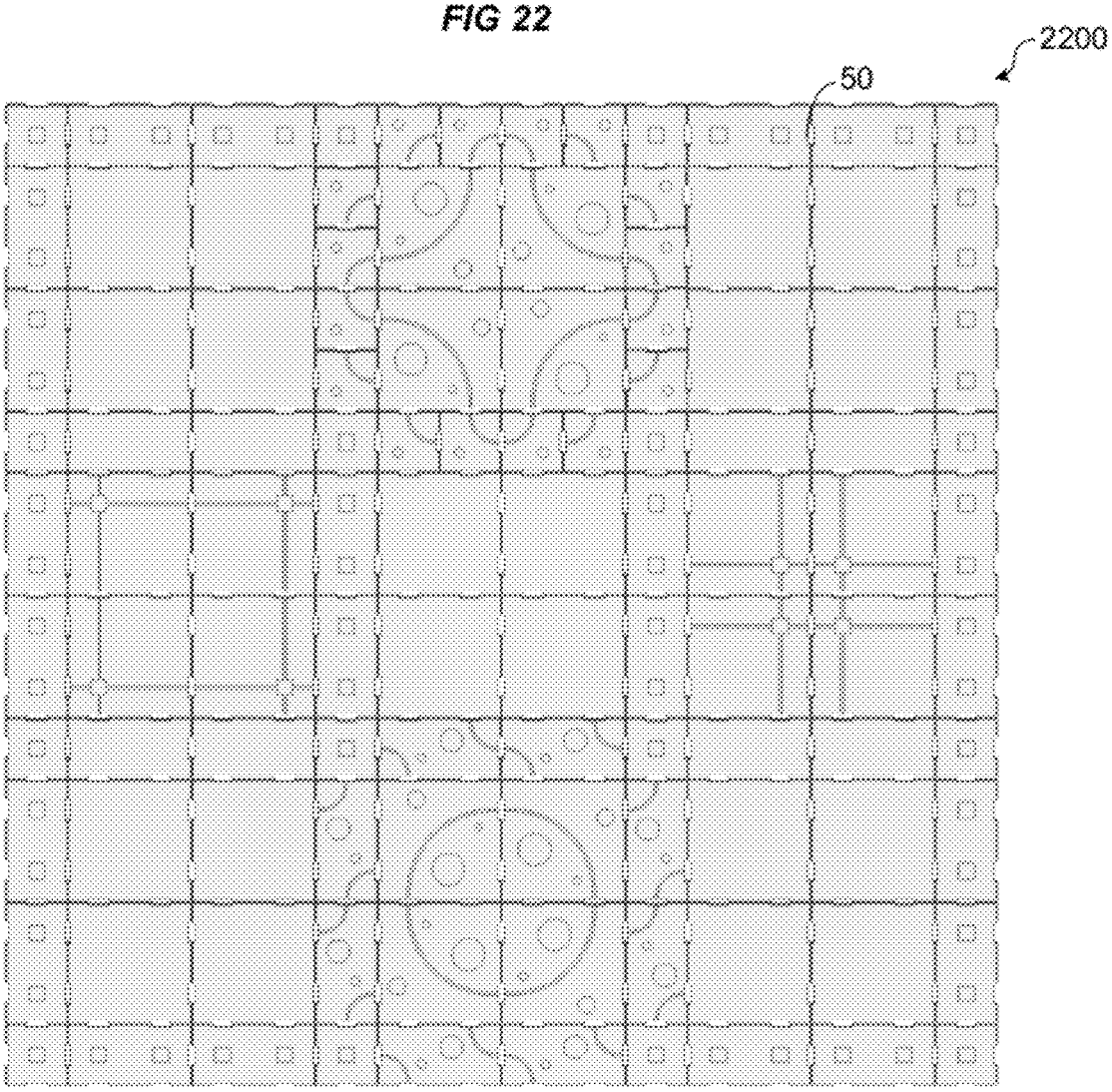
FIG. 22 is a top view illustrating an exemplary mosaic that includes paving blocks in accordance with one embodiment.
Figure 23:
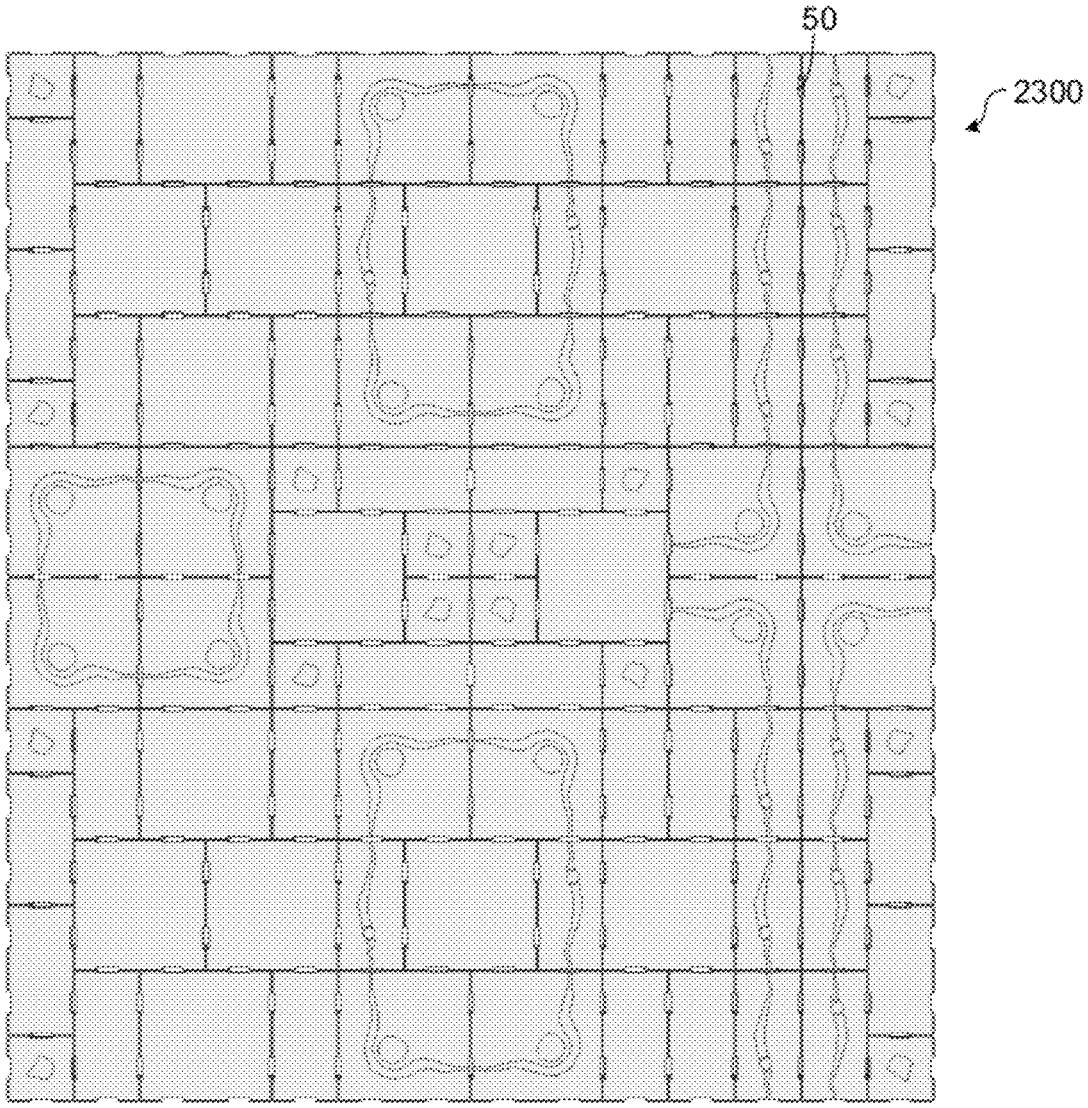
FIG. 23 is a top view illustrating an exemplary mosaic that includes paving blocks in accordance with another embodiment.

The paving blocks 100, 200, 300, 400, 500, 600 can be arranged according to any desired combination. FIGS. 14 through 21 illustrate paving block arrangements 1400, 1500, 1600, 1700, 1800, 1900, 2000, 2100 according to certain embodiments. A wide variety of designs and arrangements are possible. In some embodiments, as shown in FIGS. 18 and 19, all of the blocks are identical. FIGS. 14-17 and FIGS. 20-21 also use blocks, some of which are identical and others are not identical. The different blocks can have different sizes and/or different designs. It is relatively easy to align and abut recesses, regardless of the paving block size or design, because the blocks all have side surfaces with a width that is an integer multiple of the recess length "x." Also, as shown in FIGS. 15, 19, 20 and 21, paving blocks having channels can be positioned so that their channels abut one another to create an impression of a "continuous" channel. Additionally, the paving blocks arrangement can form large mosaics, such as mosaics 2200 and 2300 in FIGS. 22 and 23, respectively. Thus, any combination of a plurality of paving blocks either with or without a design in the top surface can be placed adjacent to one another to create an aesthetically pleasant ground cover. It should be understood that the designs and combinations shown are only exemplary and for illustrative purposes only and, as such, should not be considered as limiting the scope and spirit of the invention as disclosed herein.

Figures 24A, 24B:
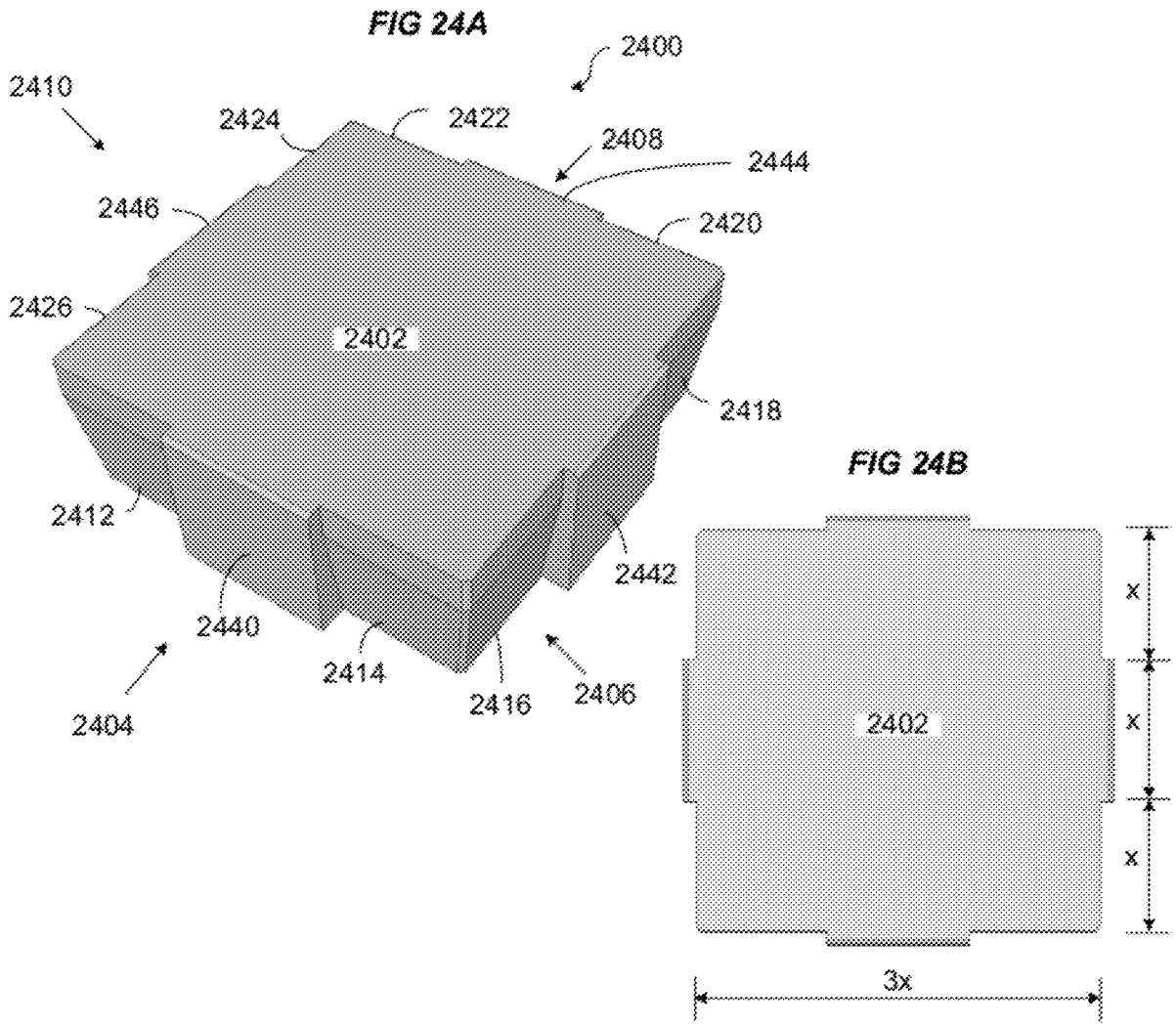
FIG. 24A is an isometric view of a paving block in accordance with another embodiment.
FIG. 24B is a plan view of the paving block of FIG. 24A.
Figure 25A:
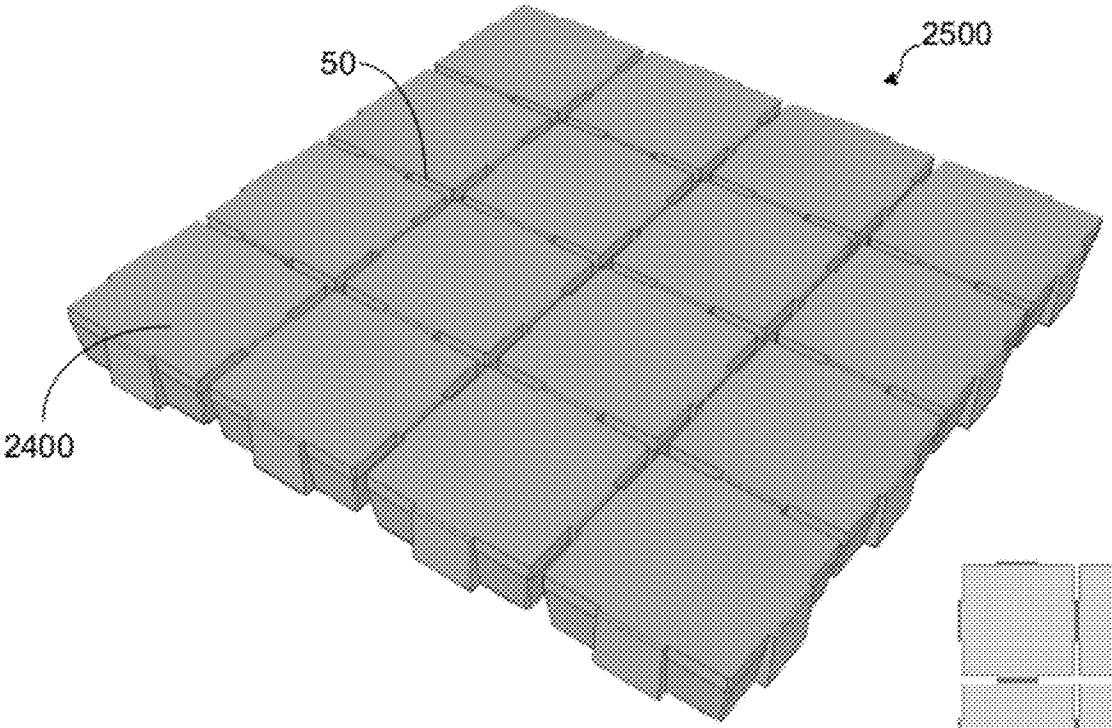
FIG. 25A is an isometric view of a paving block arrangement in accordance with another embodiment.
Figure 25B:
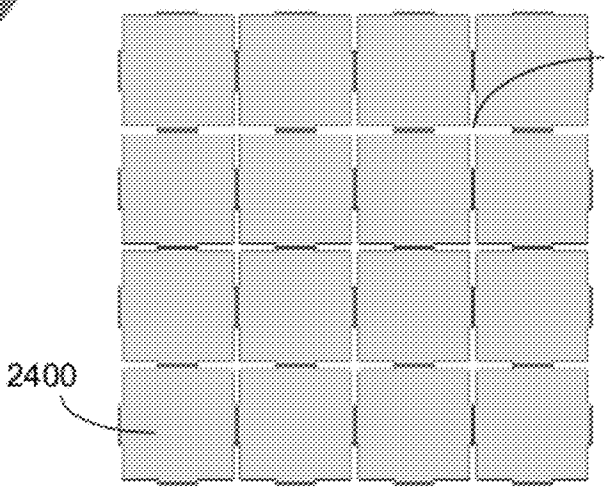
FIG. 25B is a plan view of the paving block of FIG. 25A.

Paving blocks having an inverse embodiment are also within the scope of the invention. Throughout this description, several embodiments of paving blocks are described as having one or more recesses in a side surface so that the side surfaces include recess and recess-free sections. For each of these embodiments, it is possible to inverse the recess and recess-free sections. For example, FIGS. 24A and 24B show an inverse embodiment of the paving block 100 of FIGS. 1A and 1B. As shown in FIG. 24A, an inverse paving block 2400 is provided having a substantially horizontal top surface 2402 and a substantially horizontal bottom surface (not shown). The paving block 2400 further comprises side surfaces 2404, 2406, 2408 and 2410 extending between the top surface 2402 and the bottom surface of paving block 2400. Each side surface 2404, 2406, 2408, 2410 is the inverse of each side surface 104, 106, 108 and 110 of paving block 100. The side surface 2404 includes a recess-free section 2440 in between recesses 2412, 2414, the side surface 2406 includes a recess-free section 2442 in between recesses 2416, 2418, the side surface 2408 includes a recess-free section 2444 in between recesses 2420, 2422 and the side surface 2410 includes a recess-free section 2446 in between recesses 2424, 2426. FIG. 25 shows a paving block arrangement wherein inverse paving blocks 2400 are positioned together. As shown, when the recesses in this inverse arrangement are abutted together, they form even larger drainage holes 50 in the shapes of an "x" or a cross.

Paving blocks having side surfaces that extend inwardly or have sections that extend inwardly are also within the scope of the invention. Throughout this description, several embodiments of paving blocks are described as having one or more recesses in a side surface. For each of these embodiments, it is possible to provide any of the side surfaces as surfaces that extend inwardly or have sections that extend inwardly. In other words, either the entire side surface extends inwardly or only a section of the side surface extends inward. Thus, the side surfaces described in this description can either be substantially vertical or they can extend inwardly or have sections that extend inwardly.

Figure 26:
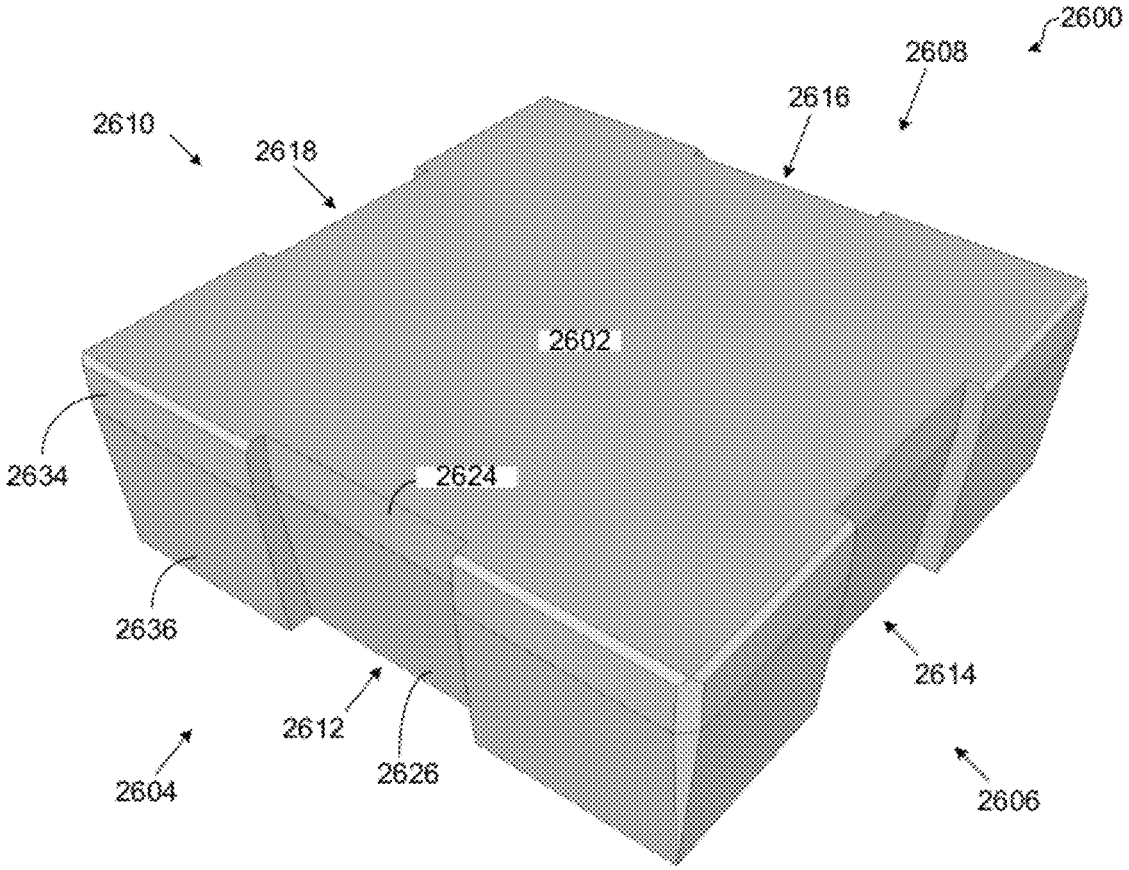
FIG. 26 is an isometric view of a paving block in accordance with another embodiment.

For example, FIG. 26 shows an embodiment of the paving block 100 of FIG. 1, wherein the side surfaces have sections that extend inwardly. As shown in FIG. 26, a paving block 2600 is provided having a substantially horizontal top surface 2602 and a substantially horizontal bottom surface (not shown). The paving block 2600 further comprises side surfaces 2604, 2606, 2608 and 2610 extending between the top surface 2602 and the bottom surface of paving block 2600. Each side surface 2604, 2606, 2608, 2610 has an upper side surface section 2634 and a lower side surface section 2636. The upper side surface section 2634 is substantially vertical whereas the lower side surface section 2636 extends inwardly into the paving block. Also, the lower side surface section 2636 is shown as having a height that is larger than the height of the upper side surface section 2634. One benefit of providing a substantially vertical upper side surface section 2634 is that it serves as a contact point for abutting other paving blocks. In other words, the substantially vertical section 2634 allows for an installer to accurately align and abut the paving block with contact points on other paving blocks. This helps in providing an accurate and consistent installation of paving blocks.

The paving block 2600 also includes recesses 2612, 2614, 2616, 2618 extending between the between the top surface 2602 and the bottom surface of paving block 2600. Each recess 2612, 2614, 2616, 2618 has an upper recess section 2624 and a lower recess section 2626. Like the side surface sections, the upper recess section 2624 is substantially vertical whereas the lower recess section 2626 extends inwardly into the paving block. Also, the lower recess section 2626 is shown as having a height that is larger than the height of the upper recess section 2624. In addition, the upper recess section has substantially the same height as the upper side surface section, although this is not required. Finally, the lower recess section extends inwardly at an angle that is substantially the same as or greater than the angle the lower side surface section extends inwardly at.

Figure 27:
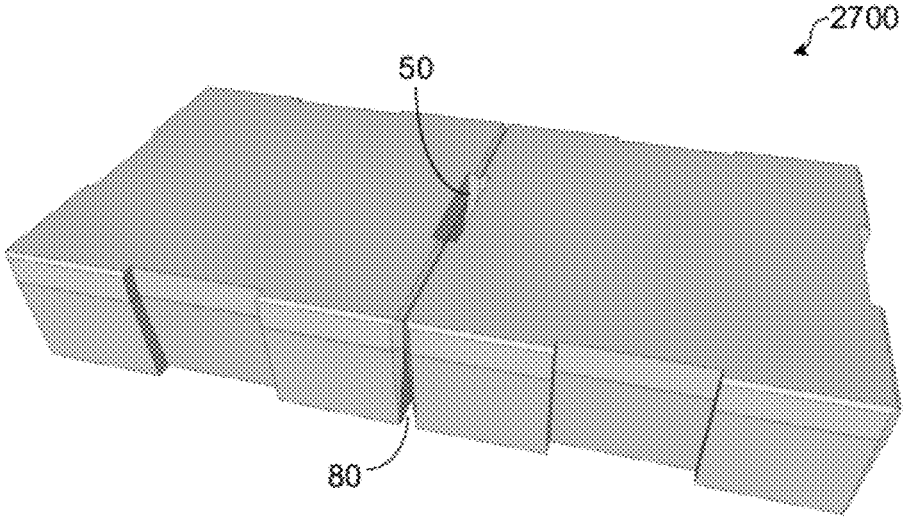
FIG. 27 is an isometric view of a paving block arrangement in accordance with another embodiment, wherein the paving block arrangement includes the paving block of FIG. 26.
Figure 28:
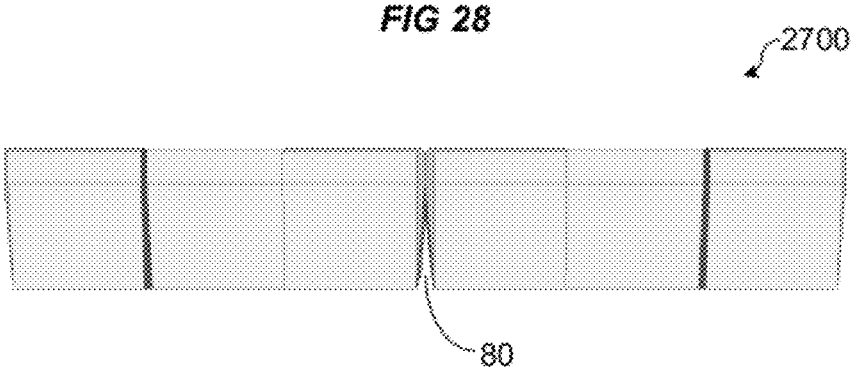
FIG. 28 is a side view of the paving block arrangement of FIG. 27.

FIGS. 27 and 28 shows a paving block arrangement wherein paving blocks 2600 are positioned together. As shown, when the recesses in this arrangement are abutted together, they form drainage holes 50. In addition, when the side surfaces are abutted together, they form additional drainage space 80 at the ground surface. This additional drainage space 80 results because the side surfaces of the paving blocks 2600 extend inwardly. Thus, the use of inwardly extending side surfaces can be advantageous in providing additional drainage space 80. Further, the additional space 80 makes it easier to install the paving blocks 2600. During typical paving block installations, installers place bedding gravel in between the paving blocks to help anchor them into place. However, sometimes the bedding gravel can cause the irregularities in traditional paving block arrangements, since larger stones in the gravel might get pinched or trapped between the paving blocks and prevent them from accurately abutting one another. However, the additional space 80 accommodates such larger stones and helps the installer to ensure that the paving blocks more accurately abut each other.

Various modifications and additions may be made to the exemplary embodiments presented hereinabove without departing from the scope and intent of the present invention. For example, while the disclosed embodiments refer to particular features, the scope of the instant invention is considered to also include embodiments having different combinations of features different from and/or in addition to those described herein. Accordingly, the scope of the present invention is intended to embrace all such alternatives, modifications, and variations as falling within the scope and intent of the appended claims, including all equivalents thereof.

What is claimed is:

1. A paving block comprising:

a top surface;

a bottom surface;

a side surface extending between the top surface and the bottom surface, wherein the side surface comprises an upper side surface section and a lower side surface section, wherein the lower side surface section extends inwardly into the paving block, wherein the upper side surface section is substantially vertical, wherein the side surface further comprises a recess extending from the top surface to the bottom surface, wherein the recess has a top opening on the top surface and a bottom opening on the bottom surface, wherein the bottom opening is larger in area than the top opening.

2. The paving block of claim 1 wherein the upper side surface section has a height and the lower side surface section has a height, wherein the lower side surface section height is greater than the upper side surface section height.

3. The paving block of claim 1 wherein the recess comprises an upper recess section and a lower recess section, wherein the lower recess section extends inwardly into the paving block.

4. The paving block of claim 3 wherein the upper recess section is substantially vertical.

5. The paving block of claim 3 wherein the upper recess section has a height and the lower recess section has a height, wherein the lower recess section height is greater than the upper recess section height.

6. The paving block of claim 1 wherein the side surface comprises an upper side surface section and a lower side surface section and the recess comprises an upper recess section and a lower recess section, wherein each the lower side surface section and the lower recess section extend inwardly into the paving block.

7. The paving block of claim 6 wherein the upper side surface section has a height and the upper recess section has a height, wherein the upper side surface section height is substantially the same as the upper recess section height.

8. The paving block of claim 6 wherein the lower recess section extends inwardly at substantially the same angle as or at a greater angle than the lower side surface section.

9. The paving block of claim 1 wherein the bottom opening has a width that is larger than a width of the top opening.

10. The paving block of claim 9 wherein the bottom opening width is at least 2 times larger than the top opening width.

11. The paving block of claim 1 wherein the entire recess continuously extends inwardly from the top surface to the bottom surface.

12. A paving block comprising:

a top surface;

a bottom surface;

a side surface extending between the top surface and the bottom surface, wherein the side surface further comprises a recess extending from the top surface to the bottom surface, wherein the recess has a top opening on the top surface and a bottom opening on the bottom surface, wherein the bottom opening is larger in area than the top opening;

wherein the side surface comprises an upper side surface section and a lower side surface section;

wherein the recess comprises an upper recess section and a lower recess section;

wherein each the lower side surface section and the lower recess section extend inwardly into the paving block; and wherein the lower recess section extends inwardly at substantially the same angle or at a greater angle than the lower side surface section.

13. The paving block of claim 12 wherein each the upper side surface section and the upper recess section is substantially vertical.

14. The paving block of claim 12 wherein the upper side surface section has a height and the lower side surface section has a height, wherein the lower side surface section height is greater than the upper side surface section height.

15. The paving block of claim 12 wherein the upper recess section has a height and the lower recess section has a height, wherein the lower recess section height is greater than the upper recess section height.

16. The paving block of claim 12 wherein the upper recess section has a height and the upper side surface section has a height, wherein the upper recess section height is substantially the same as the upper side surface section height.

17. The paving block of claim 12 wherein the bottom opening has a width that is larger than a width of the top opening.

18. The paving block of claim 17 wherein the bottom opening width is at least 2 times larger than the top opening width.

* * * * *